US008989651B2

(12) United States Patent
Mori

(10) Patent No.: US 8,989,651 B2
(45) Date of Patent: Mar. 24, 2015

(54) IMAGE FORMATION DEVICE

(75) Inventor: Hirotaka Mori, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 128 days.

(21) Appl. No.: 13/432,083

(22) Filed: Mar. 28, 2012

(65) Prior Publication Data

US 2013/0071166 A1 Mar. 21, 2013

(30) Foreign Application Priority Data

Sep. 20, 2011 (JP) ..... 2011-204718

(51) Int. Cl.
*G03G 15/00* (2006.01)
*B65H 85/00* (2006.01)
*G03G 21/16* (2006.01)

(52) U.S. Cl.
CPC ..... *G03G 21/1638* (2013.01); *G03G 15/6573* (2013.01); *G03G 2215/00544* (2013.01); *G03G 2215/00675* (2013.01); *G03G 2215/007* (2013.01)
USPC ..... 399/401

(58) Field of Classification Search
CPC ..... G03G 2221/1675; G03G 2221/1687; G03G 15/00; B65H 85/00
USPC ..... 399/364, 401, 402
See application file for complete search history.

(56) References Cited

U.S. PATENT DOCUMENTS 4,591,259 A * 5/1986 Kuo et al. ..... 399/406
4,632,533 A * 12/1986 Young ..... 399/406
5,123,895 A * 6/1992 Mandel ..... 493/459
5,448,348 A * 9/1995 Azeta ..... 399/364
5,974,283 A * 10/1999 Cho ..... 399/75
6,078,760 A * 6/2000 Abe et al. ..... 399/45
6,256,464 B1 * 7/2001 Sumiyoshi ..... 399/88
6,754,456 B2 * 6/2004 Ahn ..... 399/75
7,356,303 B2 * 4/2008 Mizuno et al. ..... 399/406
7,555,240 B2 * 6/2009 Jang ..... 399/124
7,789,388 B2 * 9/2010 Matsubara et al. ..... 399/405
2003/0063935 A1 4/2003 Seo
2004/0018034 A1 * 1/2004 Baek et al. ..... 399/405
2009/0297243 A1 * 12/2009 Matsuno ..... 399/405
2010/0247117 A1 * 9/2010 Tomatsu ..... 399/21
2011/0103809 A1 * 5/2011 Kuwata et al. ..... 399/16

(Continued)

FOREIGN PATENT DOCUMENTS

JP 11-035210 2/1999
JP 2001-117291 4/2001
JP 2001328759 A * 11/2001 ..... B65H 85/00
JP 2003-118914 4/2003
JP 2006-089203 4/2006

*Primary Examiner* — Nguyen Ha
(74) *Attorney, Agent, or Firm* — Banner & Witcoff, Ltd.

(57) ABSTRACT

An image formation device is provided with a discharge tray configured to receive the sheet discharged from a discharge exit, a guide portion configuring at least a part of a first feed path and a second feed path extending from a fixing unit to the discharge exit, a reversibly rotatable roller configured to reverse a feeding direction of the sheet fed from the fixing unit to the discharge exit so that the sheet is reversely fed toward an entrance of the of the developing unit. In this configuration, the first path and the second path are converged to form a converged feed path on the discharge exit side, the reversibly rotatable roller is provided in the converged feed path, and a converged feed path guide portion, which is a part of the guide portion, is displaceable to a position to expose the converged feed path to outside.

20 Claims, 9 Drawing Sheets

(56) References Cited

U.S. PATENT DOCUMENTS

2011/0193286 A1* 8/2011 Compera et al. ..... 271/228
2011/0243607 A1* 10/2011 Takahashi ..... 399/122
2011/0262201 A1* 10/2011 Souda ..... 399/401
2012/0020710 A1* 1/2012 Motoki ..... 399/334

* cited by examiner

IMAGE FORMATION DEVICE

CROSS-REFERENCE TO RELATED APPLICATION

This application claims priority under 35 U.S.C. §119 from Japanese Patent Application No. 2011-204718 filed on Sep. 20, 2011. The entire subject matter of the application is incorporated herein by reference.

BACKGROUND

1. Technical Field

Aspects of the present invention relate to an image formation device capable of printing images on both sides of a printing sheet.

2. Conventional Art

An example of conventional image formation device capable of printing images on both sides of a printing sheet is configures such that two independent sheet feed paths are provided from a fixing unit to a sheet discharge exit.

SUMMARY

According to the above-described image formation device, since the sheet feed paths from the fixing unit to the discharge exit are completely independent, if a sheet jam occurs, a problem as indicated below may occur.

In the above-described image formation device, it is necessary to judge the sheet feed path in which the sheet jam has occurred, and then notify a user the occurrence of the jam and the path in which the jam has occurred.

If the notification is not made, the user needs to visually check both sheet feed paths. Therefore, if the notification is not made, workability in removing the jammed sheet is lowered.

If the two sheet feed paths are arranged in a two-tiered state (e.g., arranged on further side and near side) and the jam has occurred in the further side path, the near side path is exposed to outside, and thereafter, the further side path is exposed to outside to remove the jammed sheet.

Therefore, according to the conventional image formation device, a structure for allowing the two sheet feed paths to be exposed to outside is relatively complicated. Further, the workability in removing the jammed sheet is considerably lowered.

Aspects of the invention is advantageous in that an improved image formation device is provided, with which device, the jammed sheet can be removed easily.

According to aspects of the invention, there is provided an image formation device configured to form images on a front surface and back surface of a sheet, provided with a developing unit configured to transfer a developer image on the sheet, a fixing unit provided on a downstream side of the developing unit and configured to fixed the developer image on the sheet, a discharge tray configured to receive the sheet discharged from a discharge exit, a guide portion configuring at least a part of a first feed path and a second feed path extending from the fixing unit to the discharge exit, a reversibly rotatable roller configured to reverse a feeding direction of the sheet fed from the fixing unit to the discharge exit so that the sheet is reversely fed toward an entrance of the of the developing unit. In this configuration, the first path and the second path are converged to form a converged feed path on the discharge exit side, the reversibly rotatable roller is provided in the converged feed path, and a converged feed path guide portion, which is a part of the guide portion, is displaceable to a position to expose the converged feed path to outside.

BRIEF DESCRIPTION OF THE ACCOMPANYING DRAWINGS

FIG. 1 is a cross sectional view schematically showing a structure of an image formation device according to a first embodiment of the invention.

FIG. 2 schematically shows a state where a rear cover of the image formation device is opened.

Figure 9:
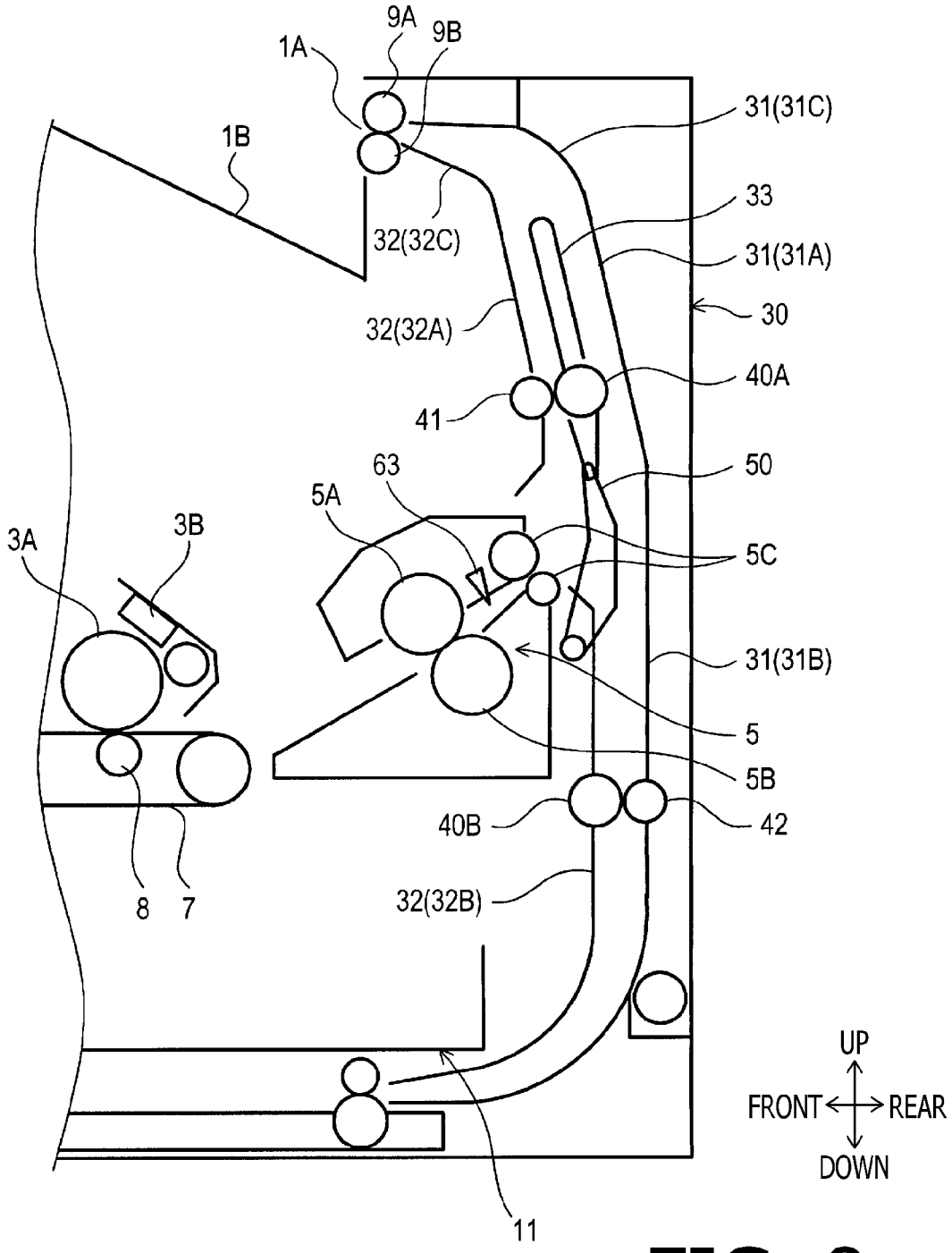

FIG. 9 schematically shows a main part of an image formation device according to a second embodiment.

DETAILED DESCRIPTION OF THE EMBODIMENTS

Hereinafter, exemplary embodiments according to aspects of the invention will be described.

Aspects of the present invention provide a laser printer capable of forming image on front/back sides of a sheet.

First Embodiment

Figure 1:
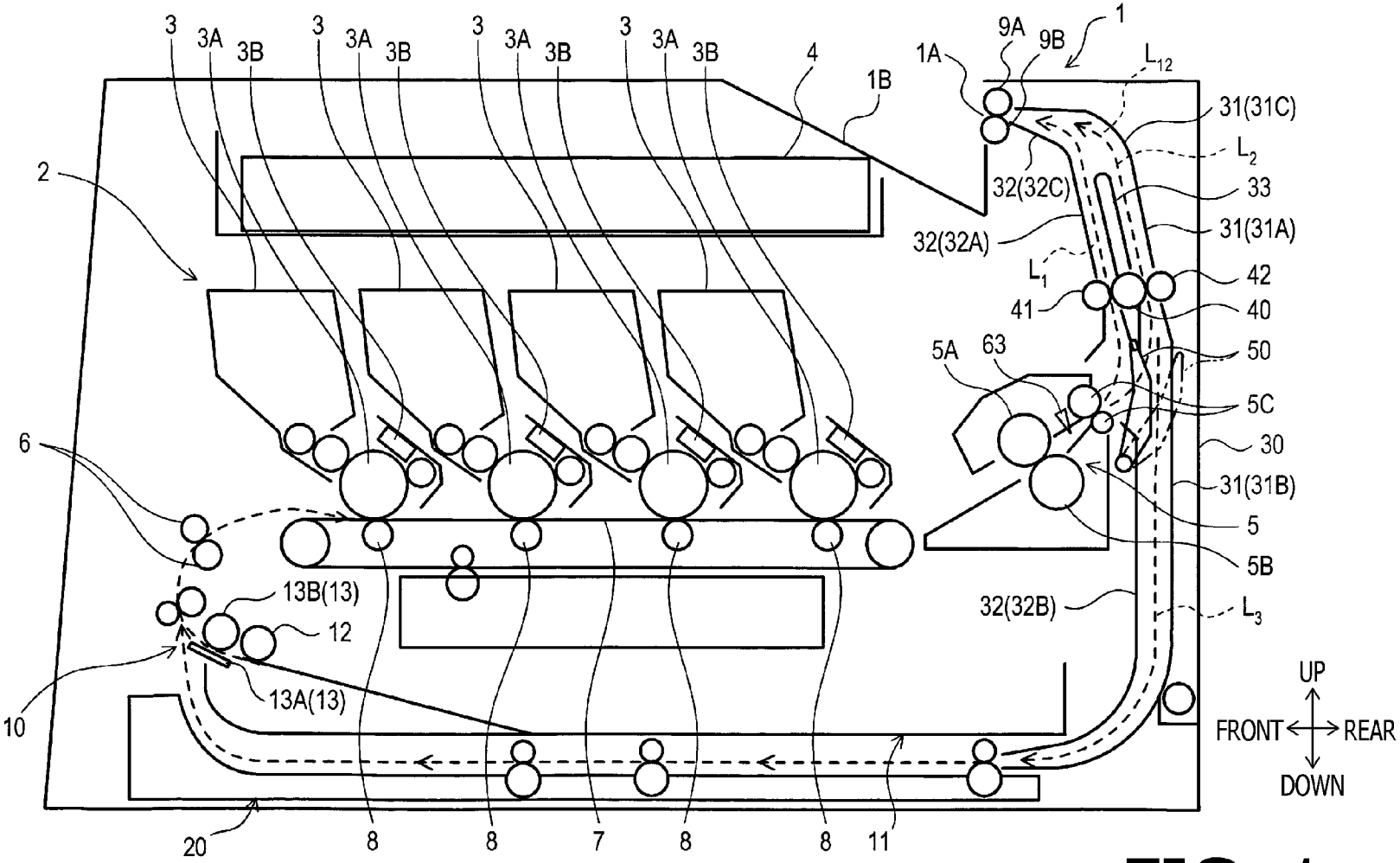

An image formation device 1 is provided with an image formation unit 2, a sheet feeding unit 10, a re-feed unit 20 and the like, as shown in FIG. 1. The image formation unit 2, the sheet feed unit 10 and the re-feed unit 20 are assembled on a main body of the image formation device 2. It is noted that a term "main body" means a portion of the image formation device, which is not normally disassembled or removed when the image formation device is in use. For example, the main body includes a hosing of the image formation device 1, and a frame to which various components are secured.

The image formation unit 2 is an image developing unit that forms a developed image on the sheet. The sheet feed unit 10 feeds the sheets placed on a sheet feed tray 11 toward the image formation unit 2. The re-feed unit 20 feeds the sheet discharged from the image formation unit 2 to an entrance side of the image formation unit 2 again The image formation unit 2 is an electrophotographic image formation device which includes one or more process cartridges 3, one or more exposure unit 4, and a fixing unit 5. Specifically, according to the first embodiment, the image formation unit 2 has a color developing units, and therefore the image formation device 2 includes a plurality of process cartridges 3 respectively corresponding to a plurality of colors of developers (i.e., black, yellow, magenta and cyan).

Each process cartridge 3 contains a photoconductive drum 3A on which the developer is adhered to develop an image, and a charger 3B which uniformly charges a circumferential surface of the photoconductive drum 3A. as the charged photoconductive drum 3A is exposed to light beam emitted by the exposure unit 4, an electrostatic latent image is formed on the circumferential surface of the photoconductive drum 3.

Thereafter, when charged developer is supplied to the photoconductive drum 3A, the developer remains at a portion corresponding to the latent image (i.e., a developed image is formed on the circumferential surface of the photoconductive drum 3).

The transfer belt 7 feeds the sheet supplied from the sheet feed tray 11 toward the photoconductive drums 3A. At portions facing the photoconductive drum 11, a plurality of transfer rollers 8 are provided with the transfer belt 7 located between the plurality of transfer rollers and the plurality of photoconductive drums 11. According to the first embodiment, with the process cartridges 3 and transfer rollers 8, the developer on the photoconductive drums 3A is transferred on the sheet.

The sheet picked up from the sheet feed tray 11 and fed toward the image formation unit 2, firstly fed to a pair of register rollers 6. The register rollers 6 correct the orientation of the sheet, and feeds the sheet further so that the sheet enters the image formation unit 2 at a predetermined timing.

The fixing unit 5 includes a heat roller 5A which contacts the sheet and applies heat to the sheet, and a pressure roller 5B which urges the sheet toward the heat roller 5A. The fixing unit 5 applies heat, with the heat roller 5A, to fix the developer (i.e., the developed image) which has been transferred onto the sheet.

The pressure roller 5B is biased toward the heat roller 5A with an elastic member such as spring (not shown). A nip pressure P1 at a nip between the heat roller 5A and the pressure roller 5B (which will also be referred to as a fixing unit side nip pressure P1) is generated by the elastic force of the elastic member.

On an upper surface of the main body (i.e., the image formation device 1), a discharge tray 1B is formed. The sheet discharged from the sheet discharge exit 1A is placed on the discharge tray 1B. At the sheet discharge exit 1A, a sheet discharge roller 9A is provided. The sheet discharge roller 9A contacts the sheet discharged from the fixing unit 5, and rotates as the sheet moves thereby applying a sheet feeding force to the sheet. The discharge roller 9A is secured to the main body.

When a simplex printing is performed (i.e., an image is printed only a front surface of the sheet), the sheet discharge roller 9A discharge the sheet which is discharged from the fixing unit 5 to the discharge tray 1B. If a duplex printing is performed (i.e., images are printed on the front and back sides of the sheet), the discharge roller 9A functions as an reverse-feed roller that reverses the feeding direction of the sheet which has been fed from the fixing unit 5 to the discharge exit 1A, and feeds the sheet toward an entrance of the developing unit 5.

The pressure roller 9B is biases toward the discharge roller 9A, similarly to the pressure roller 5B, with an elastic member (not shown). A nip pressure P2 at the nip between the discharge roller 9A and the pressure roller 9B is generated by the elastic force of the elastic member.

Incidentally, it is noted that the term "front surface" of the sheet is intended to indicate one of the two surfaces of the sheet, and the term "back surface" of the sheet is intended to indicate the other surface (i.e., the surface opposite to the "front surface"). The terms "front surface" and "back surface" are not intended to indicate specific surfaces of the sheet.

The sheet feed path is diverged to a first path L1 and a second path L2 on the discharge side of the fixing unit. The first path L1 and the second path L2 are converged to a converged feed path L12 in front of the discharge exit 1A. The discharge roller 9A is arranged on the discharge exit 1A side of the converged feed path L12.

The second path L2 communicates with a re-feed path L3 which extends to the entrance of the image formation unit 2, and is located on an outer side with respect to the first path L1, that is, on a rear side with respect to the first path L1.

A part of the re-feed path L3, below the sheet feed tray 11, is defined by re-feed unit 20, and a part of the re-feed path L3 on the upstream side, in the sheet feed direction, of the re-feed unit 20 is defined as a space between the rear cover 30 and the main body of the image formation device 1.

Figure 2:
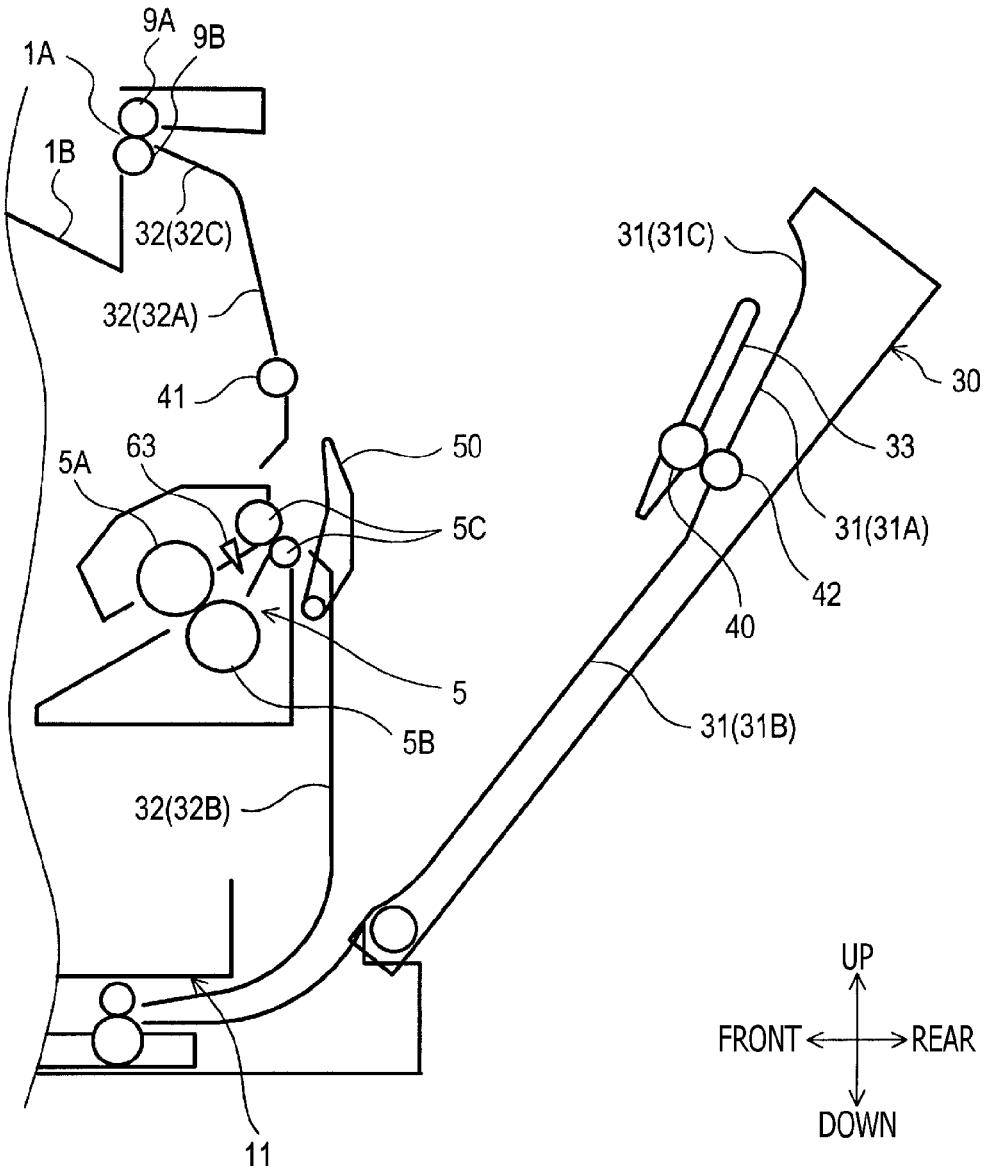

The rear cover 30 is rotatable, with respect to the main body, about the lower end portion thereof as shown in FIG. 2, between an opened position for exposing the sheet feed paths from the fixing unit 5 to the sheet discharge exit 1A (see FIG. 2) and a closed position (see FIG. 1). On an inner surface of the rear cover 30, that is on a fixing device 5 side surface of the rear cover 30, a first guide portion 31 is formed. The first guide portion 31 is a portion protruding inwardly and serves as a rear cover side guiding surface of the sheet feed path.

The first guide portion 31 includes a second path guide portion 31A, re-feed path guide portion 31B, and converged feed path guide portion 31C. It is noted that, according to the first embodiment, the first guide portion 31 (i.e., the guide portions 31A-31C) is formed of resin by integral molding with the rear cover 30.

The second path guide portion 31A is a ribbed wall, which is provided with linearly extending protrusions, configuring a rear cover side guide portion of the second feed path L2. The re-feed path guide portion 31B is a ribbed wall, which is provided with linearly extending protrusions, configuring a rear cover side guide portion of the re-feed path L3. The converged feed path guide portion 31C is a ribbed wall, which is provided with linearly extending protrusions, configuring a rear cover side guide portion of the converged feed path L12.

If the rear cover 30 is opened to expose the rear side of the image formation device 1, as shown in FIG. 2, the second path guide portion 31A, the re-feed path guide portion 31B and the converged feed path guide portion 31C are shifted rearward together with the rear cover 30. Therefore, when the rear cover 30 is opened, the rear side portions of the second feed path L2, the converged feed path L12 and the re-feed path L3 are exposed to outside.

The main body is formed with a second guide portion 32, which configures main body side guiding portions for the converging feed path L12, the re-feed path L3 and the first feed path L1. Similarly to the first guide portion 31, the second guide portion 32 includes a first path guide portion 32A, a re-feed path guide portion 32B and a converged feed path guide portion 32C.

The first path guide portion 32A is a ribbed wall, which is provided with linearly extending protrusions, configuring the main body side guide portion. The converge path guide portion 31C is a ribbed wall, which is provided with linearly extending protrusions, configuring a main body side guide portion for the converged feed path L12.

On the rear cover 30, a partition wall 33 is provided. The partition wall 33 is a rectangular plate-like member which is configured to extend in the width direction and partition the first feed path L1 and the second feed path L2. The partition 33 is attached to the rear cover 30 at positions which are shifted from the first and second feed paths L1 and L2. It is noted that the term "width direction" means a direction perpendicular to both the sheet feed direction and a thickness direction of the sheet.

On the fixing unit 5 side surface of the partition wall 33, at least one intermediate feed roller 40, which applies a feeding force to the sheet fed along the first feed path L1 or the second feed path L2, is provided. According to the first embodiment, the intermediate feed roller 40 is arranged between the first feed path L1 and the second feed path L2, as shown in FIG. 1, so that with a single roller, the feeding force is applied to the sheet fed along the first feed path L1, and to the sheet fed along the second feed path L2.

Due to the above arrangement of the intermediate feed roller 40, pressure rollers 41 and 42 which are configured to urge the sheet to the intermediate feed roller 40 are provided on both sides of the intermediate feed roller 40, sandwiching the intermediate feed roller 40 therebetween. Specifically, the pressure roller 41 is a roller which urges the sheet fed along the first feed path L1 to the intermediate feed roller 40, while the pressure roller 42 is a roller which urges the sheet fed along the second feed path L2 to the intermediate feed roller 40.

The pressure rollers 41 and 42 are urged toward the intermediate feed roller 40, similarly to the pressure roller 5B, with elastic members such as a spring (not shown). Nip pressure P3 (hereinafter, referred to as an intermediate feed roller side nip pressure) at a nip between each of the pressure rollers 41 and 42, and the intermediate feed roller 40 is generated by the elastic forces of the elastic members.

It is noted that the nip pressure (i.e., the intermediate feed roller side nip pressure P3) between the intermediate feed roller 40 and the pressure roller 41 is the same as that between the intermediate feed roller 40 and the pressure roller 42.

Further, elastic forces of the elastic members are set so that the reverse roller side nip pressure P2 is smaller than the intermediate feed roller side nip pressure P3 and the intermediate feed roller side nip pressure P3 is smaller than the fixing unit side nip pressure P1 (i.e., P2<P3<P1).

The pair of feed rollers 5C provided at the exit portion of the fixing device 5 are for changing the feeding direction of the sheet discharged from the fixing unit 5 to an upward direction. Therefore, the nip pressure of the pair of feed rollers 5C is set to be smaller than the reverse roller side nip pressure P2.

The intermediate feed roller 50 and the pressure roller 42 are rotatably secured to the rear cover 30 as shown in FIG. 2. The intermediate feed roller 40 receives a driving force from a motor (not shown in FIG. 2) which is provided to the main body.

At an axial end of the intermediate feed roller 40, a driven gear, which receives a rotating force from the main body and rotates, is provided. While, in the main body, provided is a driving gear, which engages with the driven gear described above and receives the rotation force from the motor, to transmits the rotation force to the driven gear, when the rear cover 30 is closed. Since such a configuration is well-known, the driving gear and the driven gear are not shown in FIG. 2 for brevity.

When the rear cover 30 is opened, the engagement of the driving gear with the driven gear is released. Therefore, when the rear cover 30 is opened, transmission of the rotating force from the motor to the intermediate feed roller 40 is cut. Thus, the image formation device 1 according to the first embodiment has a function of connecting/disconnecting transmission of driving force to the intermediate feed roller 40 in association with closing/opening of the rear cover.

Figure 3:
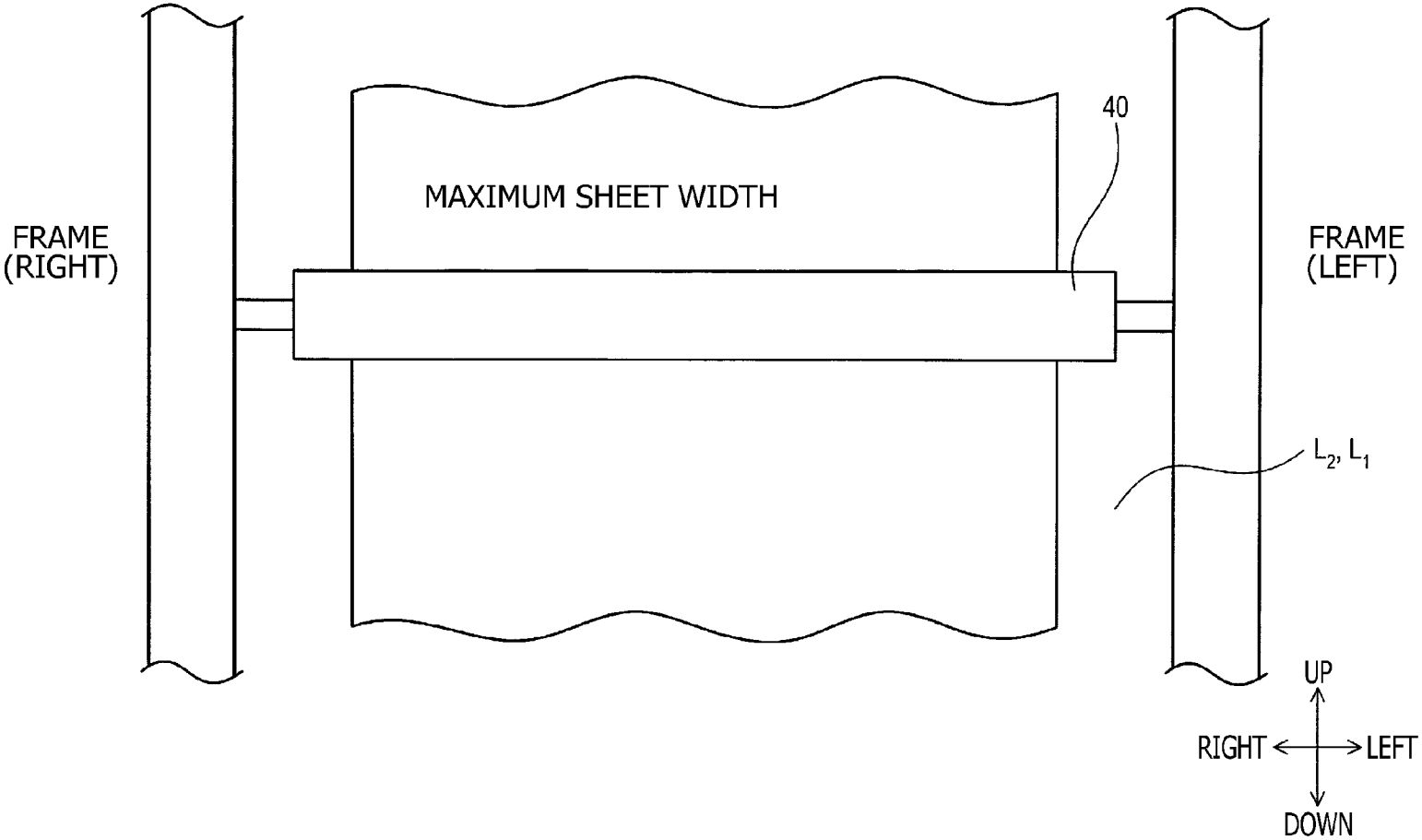
FIG. 3 shows a state where a intermediate feed roller contacts a sheet.
Figure 4:
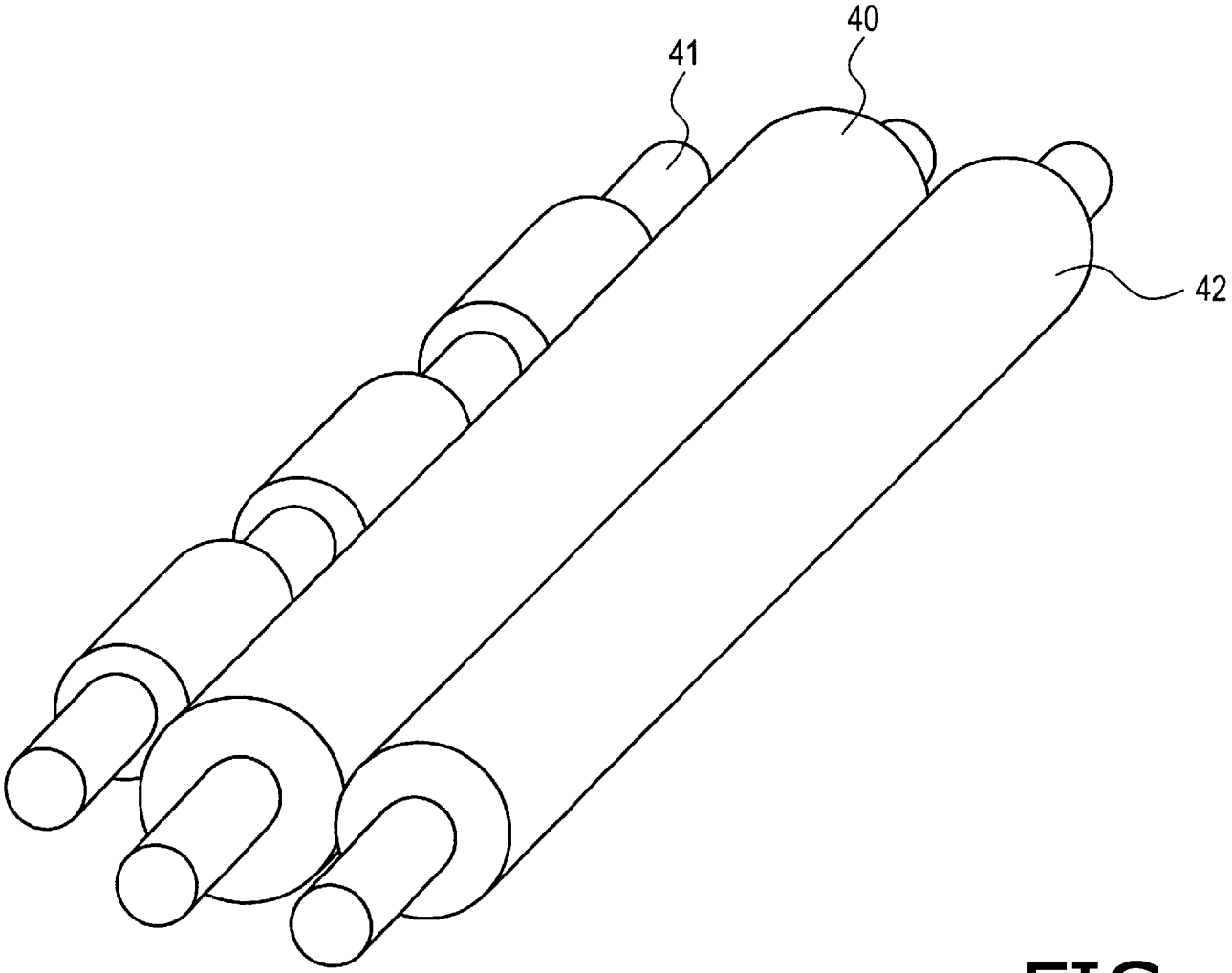
FIG. 4 is a perspective view of the intermediate feed roller and a pressure roller.

The intermediate feed roller 40 is configured to have a sufficient width (i.e., axial length) so that the intermediate feed roller 40 contacts the entire width of the sheet having a maximum size (width) which can be fed along the second path L2 (see FIG. 3). Corresponding to this configuration, the pressure roller 42 also has a sufficient width (i.e., axial length) so that the pressure roller 42 contacts the entire width of the sheet having a maximum size (width) which can be fed along the second path L2 (see FIG. 4).

Figure 5:
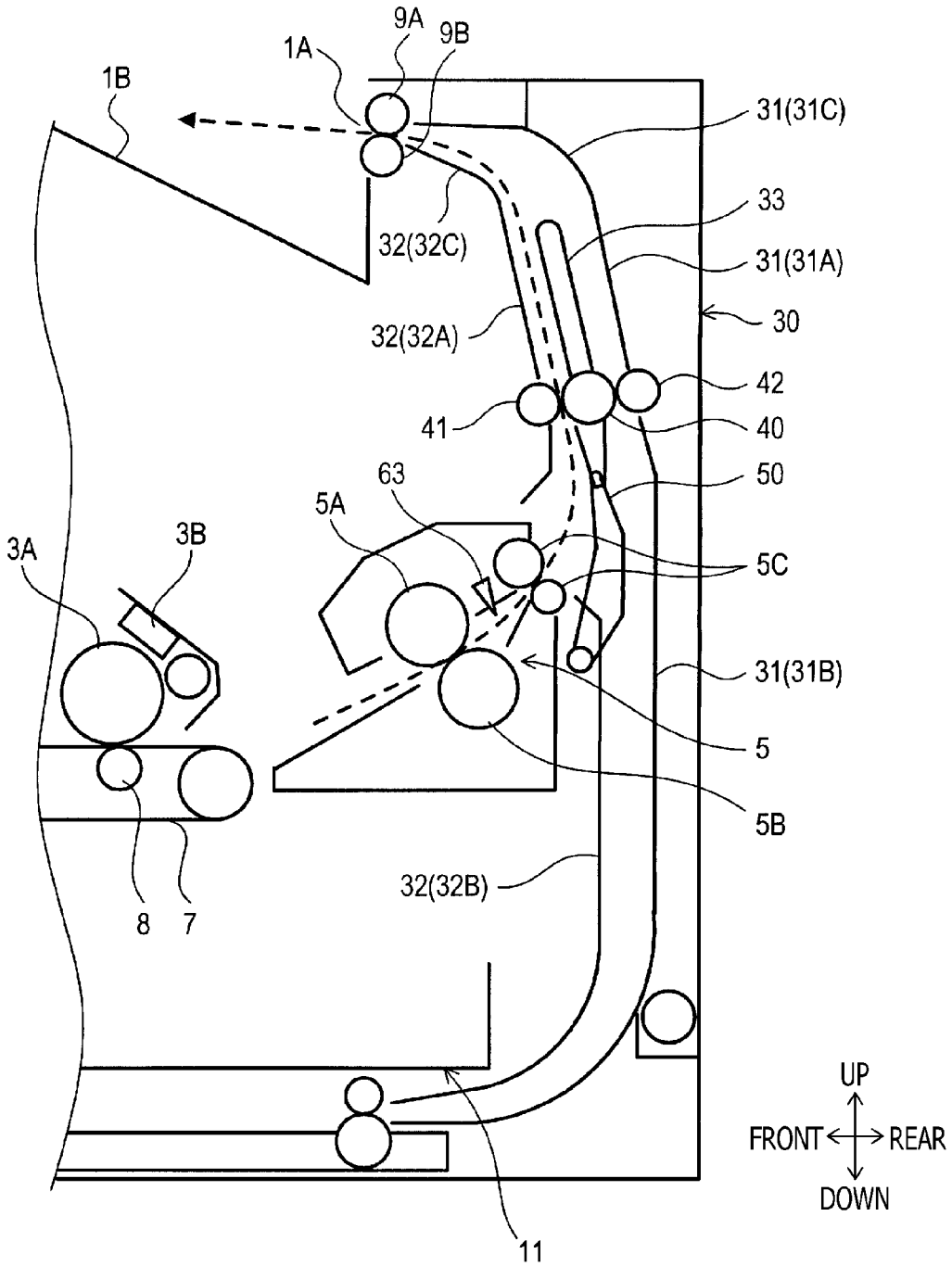
FIG. 5 shows a position of a switching flapper when a sheet is fed to a first feed path.
Figure 6:
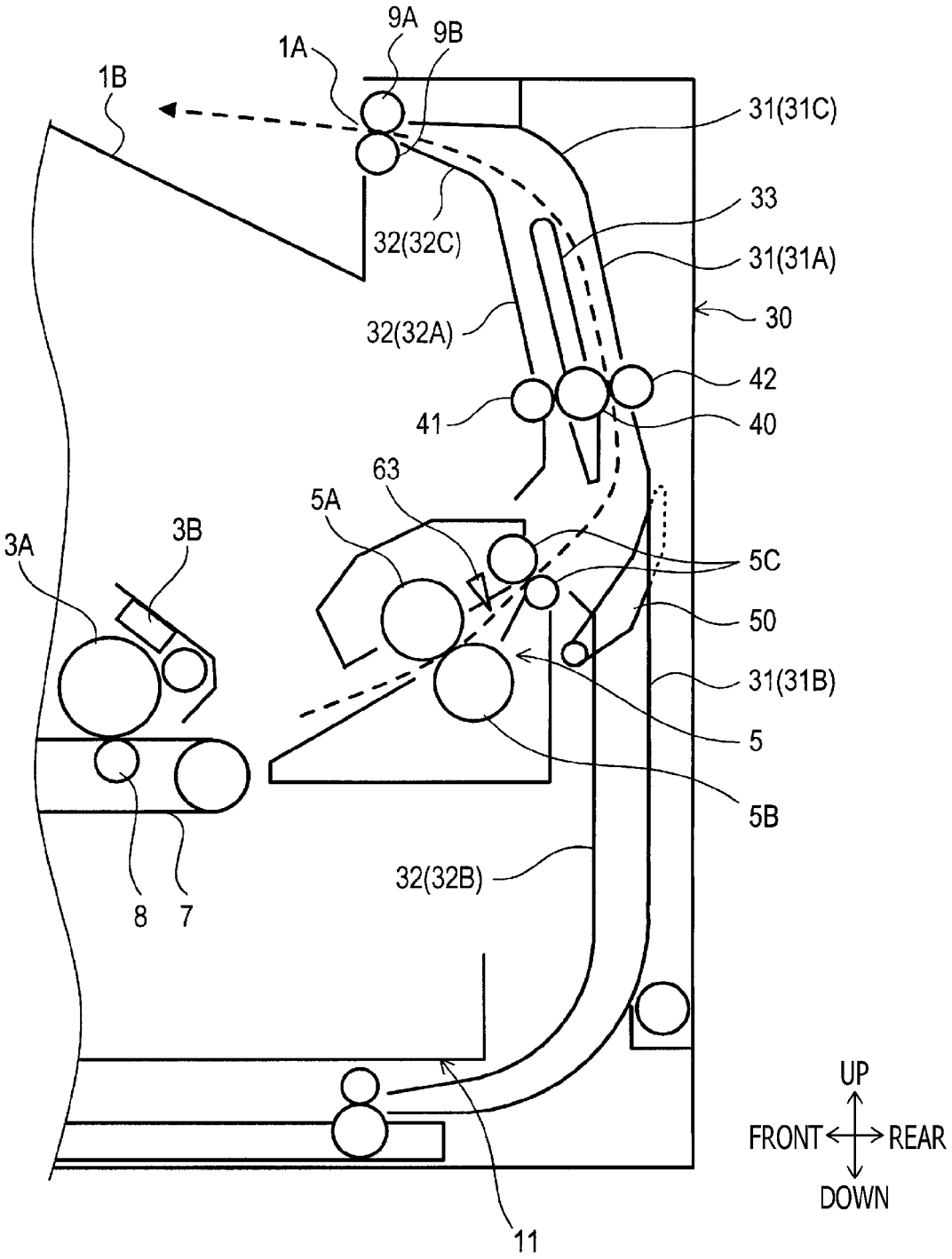
FIG. 6 shows a position of the switching flapper when the sheet is fed to a second feed path.

Incidentally, on the exit side of the fixing unit 5, a switching flapper 50 which is configured to switch the path of the sheet discharged from the fixing unit 5 between the first path L1 and the second path L2 as shown in FIG. 1. Specifically, the switching flapper 50 is rotatably located between a first position shown in FIG. 5 and a second position shown in FIG. 6.

When the switching flapper 50 is located at the first position (see FIG. 5), the sheet discharged from the fixing unit 5 is prevented from entering the second path L2. When the switching flapper 50 is located at the second position (see FIG. 6), the sheet discharged from the fixing unit 5 is allowed to enter the second path L2.

When the duplex printing is performed, and a sheet, of which an image is formed only on the front surface, is discharged from the fixing unit 5, the switching flapper 50 is located to the second position. Therefore, such a sheet is directed to the second path L2.

When a sheet of which images are formed on both the front and back side, or a sheet of which an image is to be formed only on the front surface, is discharged from the fixing device 5, the switching flapper 50 is located at the first position. Therefore, in this case, the discharged sheet is directed to the first path L1.

Figure 7:
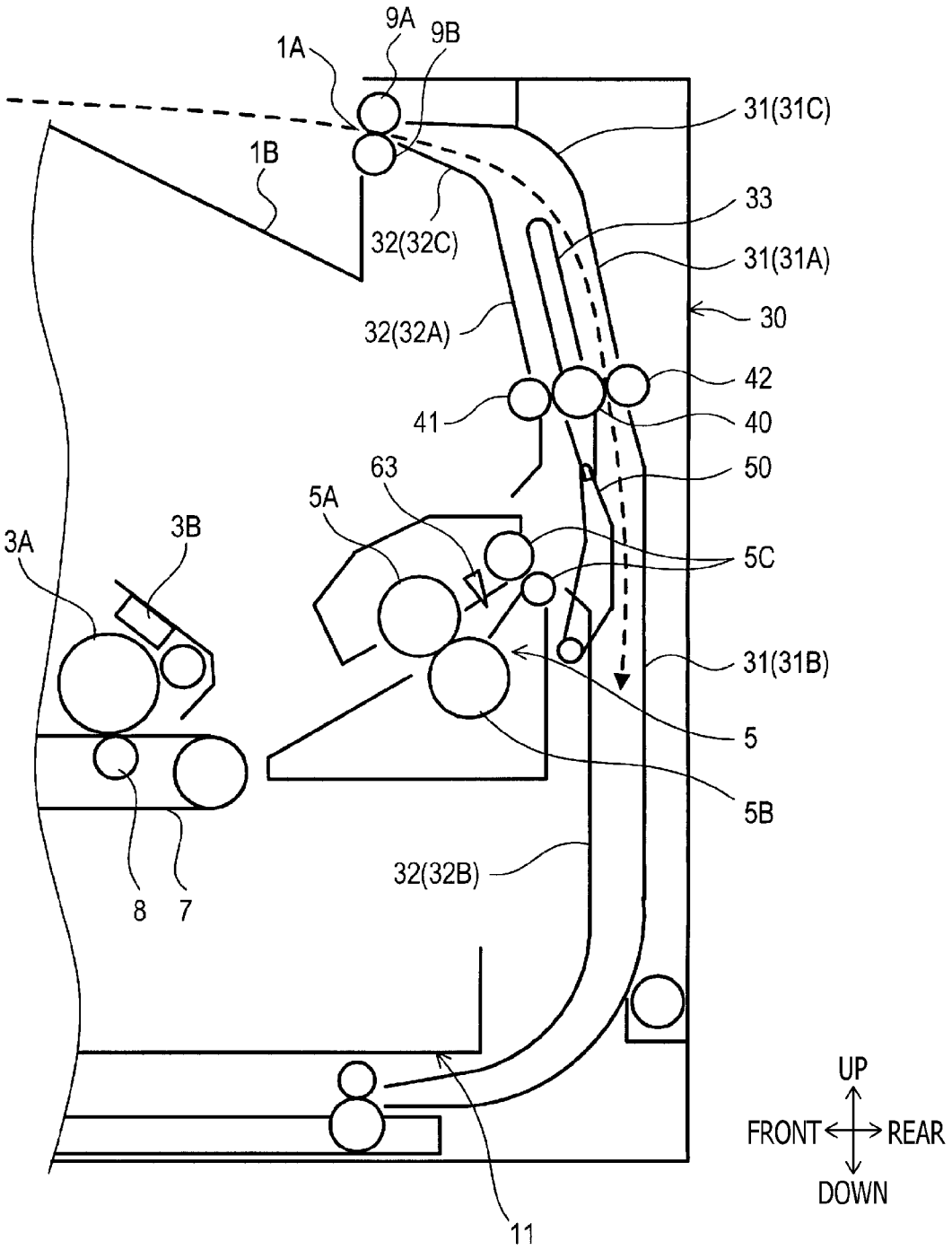
FIG. 7 shows a position of the switching flapper when the sheet is fed to a re-feed path.

When the sheet of which an image is to be formed on the back side has been directed to the second path L2 after discharged from the fixing unit 5, and the trailing end of the sheet has passed the switching flapper 50, the switching flapper 50 is switched to be located at the first position as shown in FIG. 7.

The discharge roller 9A reversely rotates to feed the sheet in the reversed direction, the sheet passes through the second path L2 and is directed to the re-feed path L3 (see FIG. 1). Then, the sheet is directed to the image formation unit 2 by the re-feed unit 20, an image is formed on the back surface, and the sheet bearing images on both sides is discharged from the fixing unit 5. Then, the sheet is fed through the first path L1 and the converged feed path L12, and discharged, by the feed roller 9A, and placed on the discharge tray 1B.

The re-feed unit 20 feed the sheet fed through the re-feed path L3 to a portion which is on the upstream side of the register roller 6 and on the downstream side of a separating mechanism 13 within a sheet feed path from the sheet feed unit 10 to the image formation unit 2.

It is noted that the sheet feed unit 10 includes a pick-up roller 12 which contacts the uppermost sheet of one or more sheets stacked on the sheet feed tray 11 and feeds the same toward the image formation unit 2, and the separating mechanism 13 provided with a separation pad 13A and a separation roller 13B.

Incidentally, the separating mechanism 13 is configured as follows. The pick-up roller 12 may feed a few sheets at a time. The separation pad 13A contacts the sheet on one side to apply a resistance force thereto, while the separation roller 13B applies a feeding force to the sheet on the other side. With this configuration, a plurality of sheets fed by the pick-up roller 12 is separated and fed one by one to the image formation unit 2.

Figure 8:
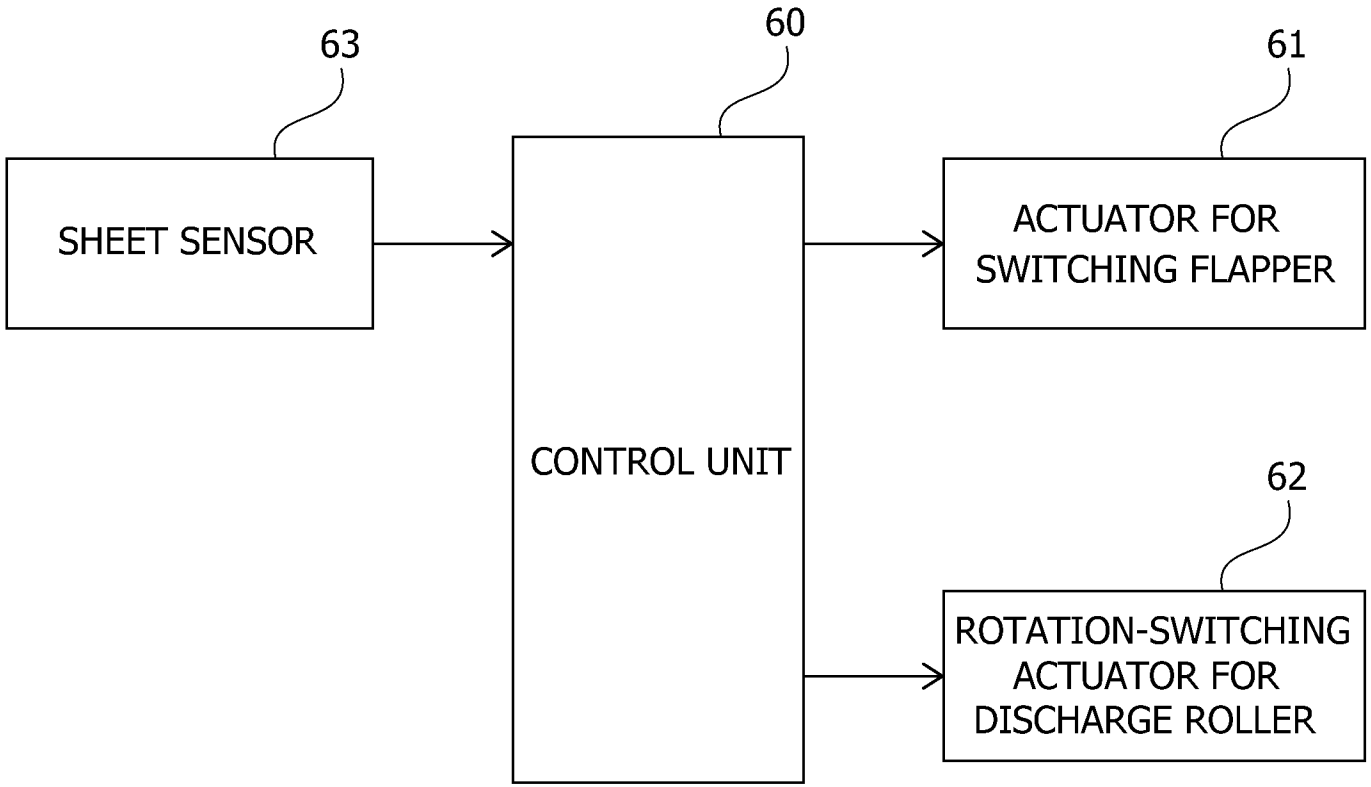
FIG. 8 is a block diagram showing a control system of the image formation device according to the first embodiment.

Movement of the switching flapper 50 and switching of forward/reverse rotation of the discharge roller 9A is controlled by a control unit 60 (see FIG. 8). The controller 60 is a well-known microcomputer which is typically provided with a CPU (central processing unit), a ROM (read only memory) and a RAM (random access memory). The control unit 60 (i.e., the CPU thereof) controls the operation of the switching flapper 50 and the discharge roller 9A in accordance with programs stored in a non-volatile storage such as a ROM.

It is noted that, according to the embodiment, when the discharge roller 9A forwardly rotates, the sheet is fed toward the discharge tray 1B, while when the discharge roller 9A reversely rotates, the sheet is fed to the entrance of the image formation unit 2 (i.e., fed toward the re-feed path L3).

The position of the switching flapper 50 is switched by an actuator 61. According to the embodiment, an electromagnetic actuator such as an electromagnetic solenoid is used as the actuator 61 of the switching flapper 50.

The forward/reverse rotation of the discharge roller 9A is switched by switching a driving force transmission path from the motor to the discharge roller 9A. Switching of the driving force transmission path is performed with use of an actuator 62 for switching the rotation direction of the discharge roller 9A. As the actuator 62, an electromagnetic actuator such as an electromagnetic solenoid.

Operational timings for controlling the actuator 61 to switch the position of the switching flapper 50, and the actuator 62 to switch the rotation directions of the discharge roller 6A are determined based on a elapsed time with respect to a time at which the leading and or trailing end of the sheet is detected by a sheet sensor 63.

Incidentally, according to the embodiment, the sheet sensor 63 is arranged in the feed path from the heat roller 5A to the feed roller 5C. Then, the sheet sensor 63 transmits a detection signal to the control unit 60.

Next, the control unit 60 changes the rotation direction of the discharge roller 9A from the forward rotation to the reverse rotation before the trailing end of the sheet fed to the discharge exit 1A through the second path L2 reaches the converged feed path L12, that is, after the leading end of the sheet has reached the discharge roller 9A and the trailing end of the sheet is in the second path L2.

According to the embodiment, the converging guide unit 31C, which is a part of the first guide member 31 and constitutes the converged feed path L12, can be displaced to a position where the converged feed path L12 is exposed to outside (see FIG. 2).

With the above configuration, regardless whether the sheet jam has occurred in the first path L1 or in the second path L2, simply by opening the converging guide unit 31C to expose the converged feed path L12 to outside, the jammed sheet can be removed easily. Therefore, according to the embodiment, the operability of the image formation device 1 can be improved, while the workability in removing the jammed sheet can be improved.

According to the embodiment, as shown in FIG. 2, the second path L2 communicates with the re-feed path L3 which extends to the entrance side of the image formation unit 2.

Further, the second path guide unit 31A, the re-feed path guide unit 31B and the converging guide unit 31C are secured to the rear cover 30 which is rotatable with respect to the main body. Therefore, according to the embodiment, by opening the rear cover 30, the jammed sheet can be removed easily.

Furthermore, according to the embodiment, the intermediate feed roller 40 is secured to the rear cover 30, while the discharge roller 9A is secured to the main body. The reverse roller side nip pressure P2 is set to be smaller than the intermediate feed roller side nip pressure P3.

With the above configuration, when the rear cover 30 is opened, the sheet is released from the discharge roller 9A, therefore, the jammed sheet can be removed easily. Specifically, since the discharge roller 9A is secured to the main body, if the sheet is jammed with being nipped at a position of the intermediate feed roller 40 and a position of the discharge roller 9A, it is necessary to open the rear cover 30 with pulling the sheet.

In such a situation, if the reverse roller side nip pressure P2 is relatively large, the sheet is strongly held by the main body, and a relatively large force is required to open the rear cover 30. Therefore, in such a configuration (i.e., the nip pressure P2 is relatively large), the workability in removing the jammed sheet is lowered.

In contrast, according to the embodiment, since the reverse roller side nip pressure P2 is smaller than the intermediate feed roller side nip pressure P3, the sheet is released from the nipped condition as the rear cover is being opened and can be released from the main body. Therefore, according to the embodiment, the jammed sheet can be removed easily.

Further, the intermediate feed roller side nip pressure P3 is set to be smaller than the fixing unit side nip pressure P1. With this configuration, the sheet is released from the intermediate feed roller 40 when the rear cover is opened, and the jammed sheet can be removed easily. Specifically, since the fixing unit 5 is provided to the main body, if the sheet is jammed with being nipped at a position of the intermediate feed roller 40 and at a position of the fixing unit 5, it is necessary to open the rear cover with pulling the sheet.

Further, in order to ensure that the developer is fixed on the sheet, the fixing unit side nip pressure P1 is generally set to have a relatively large pressure. Therefore, if the intermediate feed roller side nip pressure P3 is also set to be large, the sheet is strongly caught by the main body as well as by the rear cover 30. Then, a large force is required to open the rear cover 30, which lowers the workability in removing the jammed sheet.

In contrast, according to the embodiment, the intermediate feed roller side nip pressure P3 is set to be smaller than the fixing unit side nip pressure P1. Therefore, when the rear cover 30 is being opened, the sheet is released from the nip by the intermediate feed roller 40 and only the rear cover 30 is moved away from the main body. Therefore, the jammed sheet can be removed easily.

Incidentally, it may be possible that the fixing unit side nip pressure P1 is set to be smaller than the intermediate feed roller side nip pressure P3 so that the jammed sheet can be removed easily. However, if the fixing unit side nip pressure P1 is reduced, the developer may not be reliably fixed on the sheet. Thus, such a solution is not appropriate.

Further, according to the embodiment, the intermediate feed roller 40 receives the driving force from the main body. Therefore, if the rear cover 30 is opened, transmission of the driving force from the motor (main body) to the intermediate feed roller 40 is cut. Accordingly, when the rear cover 30 is opened, resistance force applied to a pulling force to remove the sheet nipped by the intermediate feed roller 40 (i.e., the rotational resistance of the intermediate feed roller 40) is weakened. Accordingly, the jammed sheet can be removed easily.

According to the embodiment, as shown in FIG. 3, the intermediate feed roller 40 contacts the sheet at an entire width range. Thus, according to the embodiment, it is ensured that the sheet discharged from the fixing unit can be cooled with the intermediate feed roller 40. Thus, according to the embodiment, the intermediate feed roller 40 can also be used as a cooling roller. Incidentally, the intermediate feed roller 40 contacts the sheet at an entire width range, and a sheet jam may occur on an immediate upstream side or an immediate downstream side of the intermediate feed roller 40. According to the embodiment, however, the jammed sheet can be removed easily, and thus, the operability of the image formation unit will not be lowered.

Since it is ensured that the sheet discharged from the fixing unit 5 is cooled by the intermediate feed roller 40, the developer image transferred on the sheet can be fixed, which can be done quicker.

In the meantime, when the duplex printing is performed, it is necessary to the developer images on both sides of the sheet. Therefore, when an image has been transferred on the front surface, it is preferable to cool the sheet so that the transferred developer is fixed on the sheet earlier. To enhance the cooling function, according to the embodiment, the pressure roller 42 for the second path L2 is also configured to contact the sheet at the entire with of the sheet.

According to the embodiment, the rotation of the discharge roller 9A is changed from the forward rotation to the reverse rotation before the trailing end, in the sheet feed direction, of the sheet fed toward the discharge exit 1A reaches the converged feed path L12.

With this configuration, it is ensured that the sheet can be re-fed toward the entrance of the image formation unit 2 without providing a switching flapper or the like to guide the sheet of which the feeding direction is reversed in the converged feed path L12.

The trailing end of the sheet becomes the leading end of the sheet after the feeding direction is reversed. Therefore, if the feeding direction is changed after the trailing end of the sheet has reached the converged feed path L12, it is impossible to feed the sheet to the entrance of the image formation unit unless the switching flapper or the like is provided to the converged feed path L12.

According to the embodiment, the intermediate feed roller 40 is arranged between the first path L1 and the second path L2, and is exposed to both the first path L1 and the second path L2.

With the above configuration, only with a single roller (i.e., the intermediate feed roller 40), the feeding force can be applied to the sheet fed along the first path L1 and the second path L2.

According to the embodiment, when the sheet of which images have been formed on both surfaces is discharged from the fixing unit 5, the sheet is fed to pass through the first path L1 and the converged feed path L12, and discharged by the feed roller 9A onto the discharge tray 1B.

With this configuration, it is ensured that formation of images on the sheets can be continuously without providing a relatively large interval between the sheets. Therefore, reduction of the number of sheets on which images are formed per unit time can be suppressed. That is, the duplex printing can be performed at a relatively high speed.

Second Embodiment

In the above-described first embodiment, a single intermediate feed roller 40 is provided between the first path L1 and the second path L2. According to the second embodiment shown in FIG. 9, an intermediate feed roller 40A for the first path L1 and another intermediate feed roller 40B for the second path L2 are provided.

According to the second embodiment, a circumferential speed of the intermediate feed roller 40B is set to be faster than that of the intermediate feed roller 40A, thereby increasing the re-feeding speed of the sheet toward the image formation unit 2.

In the above-described embodiments, the converged feed path guide portion 31C is formed integrally with the rear cover 30. However, the invention needs not be limited to such a configuration, and can be modified in various ways. For example, the converged feed path guide portion 31C may be provided as a member separate from the rear cover 30, and is configured to rotatable or removable with respect to the main body.

Further, in the above-described embodiments, the second path guide portion 31A, the re-feed path guide portion 31B and the converged feed path guide portion 31C are all provided to the rear cover 30. However, the invention needs not be limited to such a configuration, and can be modified without departing the scope of the invention.

Further, in the above-described embodiments, there is a case where a length of the sheet feed path from the fixing unit 5 to the discharge exit 1A is longer than the length of the sheet. Therefore, the intermediate feed roller 40 is provided. It is noted that the invention needs not be limited to such a configuration, and can be modified in various ways. For example, if the length of the sheet feed path is sufficiently short, the intermediate feed roller 40 may be omitted.

Further, in the above-described embodiments, the intermediate feed roller 40 is provided to the rear cover 30 and receives the driving force from the main body. The invention needs not be limited to such a configuration, and can be modified. For example, the intermediate feed roller 40 may be secured to the main body.

Further, in the above-described embodiments, the feeding direction of the sheet is reversed before the trailing end of the sheet fed toward the discharge exit 1A reaches the converged feed path L12. The invention needs not be limited to such a configuration and can be modified. For example, if a feeding direction changing mechanism such as a switching flapper is provided on the discharge exit side with respect to the partition wall 33, it is possible to reverse the feeding direction of the sheet after the trailing end of the sheet fed toward the discharging exit 1A has reached the converged feed path L12.

What is claimed is:

1. An image formation device configured to form images on a front surface and back surface of a sheet, the image formation device comprising:

a developing unit configured to transfer a developer image on the sheet;

a fixing unit provided on a downstream side of the developing unit and configured to fix the developer image on the sheet;

a discharge tray configured to receive the sheet when the sheet is discharged from a discharge exit;

a guide portion configuring at least a part of a first feed path and at least a part of a second feed path, wherein the first feed path and the second feed path both extend from the fixing unit to the discharge exit and converge to form a converged feed path prior to the discharge exit; and a reversibly rotatable roller configured to reverse a feeding direction of the sheet fed from the fixing unit to the discharge exit so that the sheet is reversely fed toward an entrance of the developing unit;

a switching member arranged downstream, in the feeding direction of the sheet, with respect to the fixing unit, the switching member configured to switch a path of the sheet between the first feed path and the second feed path; and a partition wall arranged downstream, in the feeding direction of the sheet, with respect to the switching member, the partition wall partially separating the first feed path and the second feed path.

2. The image formation device according to claim 1, further comprising:

a cover member which is rotatable with respect to a main body of the image formation device, wherein the second path communicates with a re-feed path extending to the entrance of the developing unit, and wherein the cover member forms at least a part of the second feed path and at least a part of the re-feed path.

3. The image formation device according to claim 2, wherein the partition wall is attached to the cover member.

4. The image formation device according to claim 2, further comprising at least one intermediate feed roller configured to apply a feeding force to the sheet fed along either of the first feed path and the second feed path.

5. The image formation device according to claim 4, further comprising a first pressure roller comprising an elastic member and configured to urge the sheet toward the at least one intermediate feed roller, wherein the at least one intermediate feed roller is secured to the cover member, wherein the fixing unit comprises:

a heat roller configured to contact the sheet and to apply heat to the sheet; and a third pressure roller comprising an elastic member and configured to urge the sheet toward the heat roller, wherein a nip pressure between the at least one intermediate feed roller and the first pressure roller is less than a nip pressure between the heat roller and the third pressure roller.

6. The image formation device according to claim 4, wherein the at least one intermediate feed roller is configured to contact an entire width of the sheet being fed, the width of the sheet being a length of a sheet in a direction perpendicular to the feeding direction of the sheet.

7. The image formation device according to claim 4, wherein the at least one intermediate feed roller consists of a single roller provided between the first feed path and the second feed path, and wherein a circumferential surface of the single roller is exposed to both the first feed path and the second feed path.

8. The image formation device according to claim 4, further comprising:

a first pressure roller comprising an elastic member, the first pressure roller configured to urge the sheet toward the at least one intermediate feed roller; and a second pressure roller comprising an elastic member, the second pressure roller configured to urge the sheet toward the reversibly rotatable roller, wherein the at least one intermediate feed roller is secured to the cover member, wherein the reversibly rotatable roller is secured to the main body, and wherein a nip pressure between the reversibly rotatable roller and the second pressure roller is less than a nip pressure between the at least one intermediate feed roller and the first pressure roller.

9. The image formation device according to claim 8, wherein the at least one intermediate feed roller is driven by a motor within the main body.

10. The image formation device according to claim 1, wherein when an image has been formed on the front surface of the sheet and an image is to be formed on the back surface of the sheet, the switching member is configured to be in a second position to direct the sheet to the second feed path, wherein when images have been formed on both the front surface and the back surface of the sheet, the switching member is configured to be in a first position to direct the sheet to the first feed path, and wherein when an image has been formed on the front surface of the sheet and an image is not to be formed on the back surface of the sheet, the switching member is configured to be in the first position to direct the sheet to the first feed path.

11. The image formation device according to claim 1, wherein the reversibly rotatable roller is configured to reverse the feeding direction of the sheet before a trailing end of the sheet, moving in the feeding direction toward the discharging exit, reaches the converged feed path.

12. The image formation device according to claim 1, wherein the fixing unit comprises a roller configured to feed the sheet into the first feed path when the switching member is in a first position and the second feed path when the switching member is in a second position as the sheet exits the fixing unit.

13. The image formation device according to claim 1, wherein the reversibly rotatable roller is provided in the converged feed path.

14. The image formation device according to claim 1, wherein the guide portion comprises a converged feed path guide portion configured to be displaceable to a position that exposes the converged feed path to an outside of the image formation device.

15. The image formation device according to claim 1, wherein the switching member is located at an exit of the fixing unit, and wherein the fixing unit comprises a roller configured to feed the sheet to contact the switching member.

16. The image formation device according to claim 1, wherein the converged feed path is formed between the partition wall and the discharge exit.

17. The image formation device according to claim 1, wherein the partition wall is attached to a cover and configured to rotate with the cover to an open position in which user access to the first feed path is provided.

18. The image formation device according to claim 1, further comprising:

a controller configured to control movement of the switching member and rotation of the reversibly rotatable roller such that the sheet is fed in both directions through the second feed path and only in the feeding direction through the first feed path.

19. An image formation device comprising:

a photoconductive drum configured to provide an image on a sheet;

a fixing roller configured to fix the image on the sheet;

a discharge tray configured to receive the sheet when the sheet is discharged from a discharge exit;

a guide portion configuring at least a part of a first feed path and at least a part of a second feed path, wherein the first feed path and the second feed path both extend from the fixing roller to the discharge exit and converge to form a converged feed path prior to the discharge exit;

a partition wall partially separating the first feed path and the second feed path;

a switching member configured to switch a path of the sheet, when the sheet is moving in a feeding direction, between the first feed path on a first side of the partition wall and the second feed path on a second side of the partition wall; and a reversibly rotatable roller configured to reverse the feeding direction of the sheet fed from the fixing roller toward the discharge exit.

20. The image formation device according to claim 19, wherein the converged feed path is formed between the partition wall and the discharge exit, and wherein the partition wall is attached to a cover and configured to rotate with the cover to an open position in which the first feed path is exposed to a user.

* * * * *